US005251907A

United States Patent [19]

Ady

[11] Patent Number: 5,251,907

[45] Date of Patent: Oct. 12, 1993

[54] SONIC ARCHERY BEACON

[76] Inventor: Daniel D. Ady, Rte. 3, Box 435, Caldwell, Id. 83605

[21] Appl. No.: 931,026

[22] Filed: Aug. 14, 1992

Related U.S. Application Data

[63] Continuation-in-part of Ser. No. 741,808, Aug. 6, 1991, abandoned.

[51] Int. Cl.[5] ..... F42B 6/04

[52] U.S. Cl. ..... 273/416; 455/98; 200/61.45 M

[58] Field of Search ..... 273/416, 419, 420, 421, 273/422, 423, 213, 58 E, 58 G; 342/386, 419, 385; 343/720; 102/216; 455/96, 98, 66, 100, 127; 200/61.45 M, 82 E; 335/205

[56] References Cited

U.S. PATENT DOCUMENTS

| | | | |
|---|---|---|---|
| 1,194,018 | 8/1916 | Hartner | 43/3 X |
| 3,273,553 | 9/1966 | Doyle | 273/416 X |
| 3,611,220 | 10/1971 | Hoffman | 200/82 EX |
| 3,790,948 | 2/1974 | Ratkovich | 342/386 |
| 3,865,374 | 2/1975 | Troncoso, Jr. | 273/416 |
| 3,944,764 | 3/1976 | Hirashima | 200/61.45 M |
| 4,314,425 | 2/1982 | Lipsitz et al. | 43/3 x |
| 4,421,319 | 12/1983 | Murphy | 273/416 |
| 4,595,200 | 6/1986 | Shishido | 273/58 G |
| 4,635,242 | 1/1987 | Hart | 367/134 |
| 4,669,728 | 6/1987 | Carden | 273/138 A |
| 4,675,683 | 6/1987 | Robinson et al. | 273/416 X |
| 4,704,612 | 11/1987 | Boy et al. | 273/416 X |
| 4,744,347 | 5/1988 | Dodge | 273/416 X |
| 4,749,198 | 6/1988 | Brailean | 273/416 |
| 4,836,557 | 6/1989 | Polando | 273/416 |
| 4,858,935 | 8/1989 | Capson | 273/416 |
| 4,885,800 | 12/1989 | Ragle | 455/98 |
| 4,976,442 | 12/1990 | Treadway | 273/416 |
| 5,024,447 | 6/1991 | Jude | 273/416 |
| 5,141,229 | 8/1992 | Roundy | 273/416 |

*Primary Examiner*—V. Millin
*Assistant Examiner*—Sebastiano Passaniti
*Attorney, Agent, or Firm*—Frank J. Dykas; Craig M. Korfanta; Ken J. Pedersen

[57] ABSTRACT

A sonic archery beacon (10) is disclosed which employs a circuit (21) carried by an arrow (1) which includes an audible signal generator being configured to mimic the sound of a naturally occurring insect, bird or the like. Circuit (21) is activated by an inertia switch (22) which is responsive to a drastic change in acceleration such as that experienced when an arrow impacts with an object, animal or the ground. The audible signal generator implements an oscillator (23) in combination with a miniature speaker or piezo electric transducer (24) having an output which mimics a cricket. Magnetic/mechanical inertia switch (22) has a magnet (32) slidably positioned within a tube (26) having ferromagnetic objects (34 and 35) at both ends of tube (26). When the magnet (32) is positioned at one end of the tube against the pair of and will close in response to the magnetic field of magnet (25) when the magnet is positioned at that end.

8 Claims, 5 Drawing Sheets

SONIC ARCHERY BEACON

RELATED APPLICATIONS

This application is a continuation-in-part application of Application, Ser. No. 07/741,808 filed Aug. 6, 1991, and now abandoned.

BACKGROUND OF THE INVENTION

1. Technical Field

This invention generally relates to a finding apparatus and in particular it relates to a sonic beacon for use by archers in locating their arrows without alarming any prey.

2. Background Art

Archery hunters oftentimes spend as much or more time hunting for lost arrows as they spend hunting for their prey. Consequently, several attempts have been made to develop devices to aid hunters in finding their arrows. Generally, the devices are divided into two categories, those employing radio transmitters on the arrows and those employing audible transmitters on the arrows. To date, neither have found significant acceptance.

The radio direction finding technology has seen fairly limited use. For the average archer, radio direction finding arrow locators have proven expensive, inefficient, and generally too complex for anyone less than a ham radio operator to operate. However, one major advantage that the radio transmitters have over their audible counterparts is that the radio transmitters are silent and therefore do not frighten the game away. The idea of not frightening game away is most important when the hunter has missed his or her first shot. Any noise which is not natural will tend to scare the prey away. Having a beacon which is silent won't alarm the prey and thereby allow the hunter to get a second shot off.

A typical arrow finding transmitter is taught in Robinson et al., U.S. Pat. No. 4,675,683. Robinson et al. teaches a miniature transmitter housed in a cylindrical housing which is coextensively attached between the arrow head and arrow shaft. The transmitter advantageously uses the metallic arrow shaft as the radiating element of the antenna.

Sloan et al., U.S. Pat. No. 3,336,530, teaches a direction finding receiver for use with Robinson arrow transmitter. The receiver taught by Sloan is intended for receiving a modulated signal and uses a bi-directional loop antenna. Loop antennas are known to have a limited range and are very susceptible to reflective wave reception. Sloan teaches a direction finding system whose range is limited to about a quarter of a mile on relatively flat terrain.

A second radio transmitter equipped arrow is taught by Boy U.S. Pat. No. 4,704,612. However, Boy teaches using an inertia activated switch to activate the transmitter circuit. The obvious advantage is the power saving feature realized by not having the circuit energized prior to impact. However, the inertia switch is a momentary switch and consequently, additional circuitry is necessary to provide continued activation of the circuit.

A prior audible transmitting arrow locator is taught in U.S. Pat. No. 4,421,319 to Murphy. This patent teaches the use of an arrow nock having a hollow cavity which houses a miniaturized electronic buzzer being energized after a pre-selected time delay by a timing circuit such as a 555 timing IC. The signal emitted from the device is very foreign to the environment and often scares the game away from the area. Additionally, depending on the type of game being hunted, oftentimes the hunter must nock the arrow on the bow string and draw it into a shooting position, holding it there for several minutes before he is able to shoot. Obviously, if the hunter activates the timer when he nocks the arrow as Murphy teaches, the timer could very well time out and activate the buzzer before the arrow has even been released, scaring the game away.

What is needed is an arrow locator which exhibits the low cost, compact, and ease of use features of the prior art audible transmitters and at the same time also doesn't scare potential pray away by emitting a conspicuous signal. It is therefore an object of the present invention to provide an arrow with a small inexpensive audible beacon which is activated upon impact and which emits an audible signal which mimics a naturally occurring sound to aid in the location of the archer's arrows and possibly allow the hunter to get a second shot or shots off.

DISCLOSURE OF INVENTION

These and other objects are accomplished by a circuit carried by an arrow which includes an audible signal generator being configured to mimic the sound of a naturally occurring insect, bird or the like. The circuit is activated by a latching inertia switch which is responsive to a change in acceleration such as that experienced when an arrow impacts with an object, animal or the ground. The latching capability of the switch enables reliable continuous activation without expensive supporting circuitry.

Here the audible signal generator has been implemented using an oscillator in combination with a micro-speaker, or other miniature audio element such as piezo transducer, having an output which mimics a cricket. The audio element is configured to emit a pulsed tone group of 2.3 khz. An oscillator supplies a series of pulse signals of the desired frequency to the micro-speaker to selectively activate it to mimic a cricket. Other contemplated indigenous sounds could include rodent sounds such as the chirp of a chipmunk or ground squirrel, various bird sounds, amphibian sounds like the croak of a frog or any other sound which naturally occurs in the hunting environment.

A magnetic/mechanical latching inertia switch activates the oscillator in response to the arrow impacting something. The latching switch has a cylindrical magnet slidably positioned within a tube having ferromagnetic objects at both ends of the tube. When the arrow impacts, the magnet slides forward, coming to rest in contact with both ferromagnetic objects, thereby latching the circuit in its active mode. Applying a sharp blow to the nock end of the arrow will cause the magnet to shift to the other end and deactivate the circuit.

A utility hearing amplifier can be employed to locate distant archery beacons. The present inventors have used an amplifier specially tuned to the frequency band immediately surrounding the signal frequency of the sonic archery beacon with great success.

BEST MODE FOR CARRYING OUT INVENTION

Figure 1:
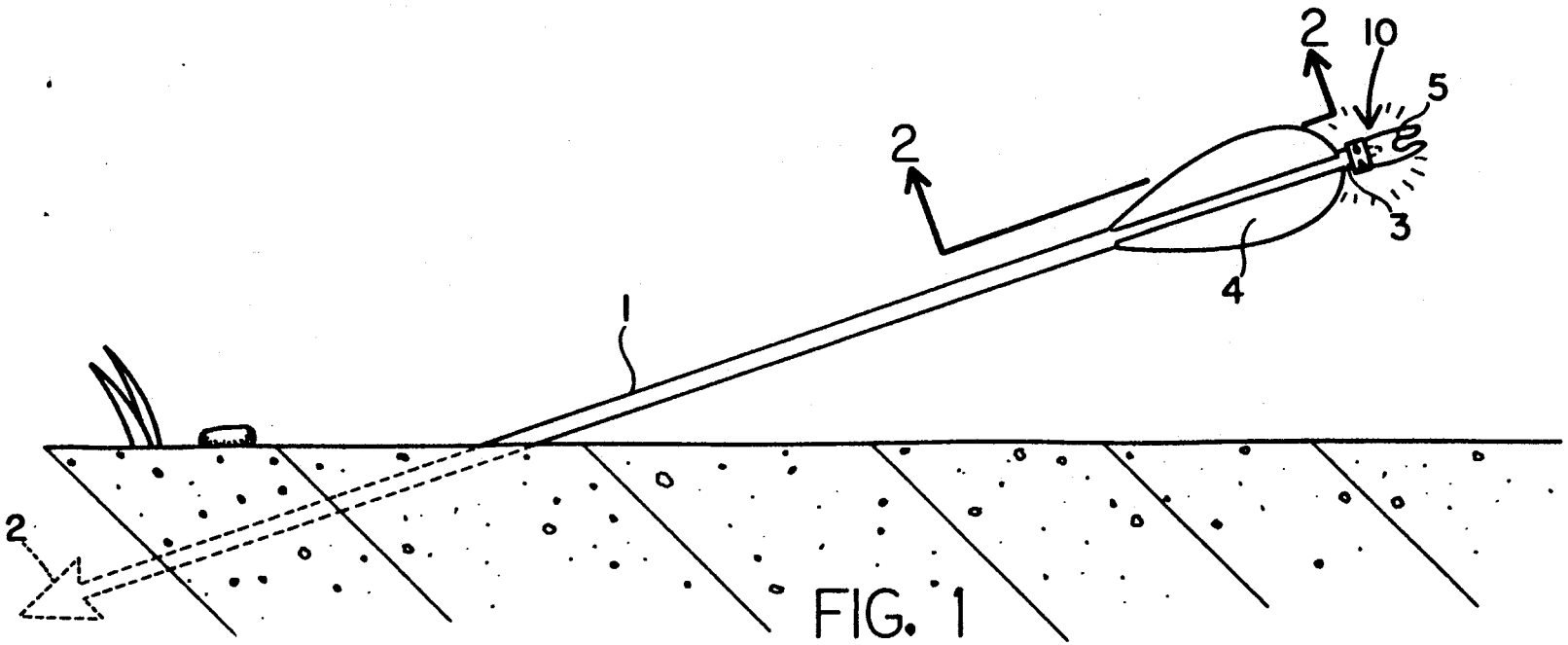
FIG. 1 is an elevation view in partial cross-section showing an arrow stuck in the ground, complete with the sonic archery beacon.

Referring now to the figures, sonic archery beacon 10 is housed within tubular housing 11 and is manufactured using small surface mount components. Tubular housing 11 is generally manufactured from a suitable insulating plastic such as Nylon® by injection molding or the like. Preferably, housing 11 is made of about 75 weight % Nylon ST-801® and about 25 weight % Nylon 66®. Tubular housing 11 includes an enlarged sound cylinder 12 located at its distal end having sound ports 13 therein. A friction fit collar is provided forward of sound cylinder 12 for attachment of tubular housing 11 within the nock end 3 of arrow 1. A nock attachment cone 29 is attached to the distal end of enlarged sound cylinder 12 to provide an attachment point for nock 5. Nock 5 is generally epoxied or otherwise glued to nock attachment cone 29.

Circuit 21 is generally comprised of four main components, the first being a latching inertia switch 22, the second, an oscillator 23, the third, a miniature speaker or piezo transducer 24, such as a K 1600TU493, and the fourth, a power supply which here consists of batteries 16. Circuit 21 employs surface mount technology on a small circuit board 15. Latching inertia switch 22, oscillator 23 and miniature speaker 24 are all attached directly to circuit board 15. Oscillator 23 here consists of a 556 timer, or a pair of 555 timers, and supporting electronics configured as shown. The output of this configuration was designed to mimic the indigenous sound of a cricket by emitting a pulsed tone of 2.3 kilohertz.

The first embodiment uses a latching inertia switch 22 which uses a small tube 26 having a known inside diameter and constructed of a non-ferrous material such as plastic as the switch housing. A small cylindrical rare earth ceramic magnet 25 is slidably positioned within tube 26 and has a diameter slightly smaller than the inside diameter of tube 26 to allow freedom of movement within the tube. Two ferromagnetic objects 27 are positioned at each end of tube 26 to interact with the magnetic field produced by cylindrical magnet 25. Tube 26 is positioned on circuit board 15 such that the axis of the tube is in line with the shaft of arrow 1 and one of the ferromagnetic objects 27 is closest to arrow head 2 while the other of the ferromagnetic objects 27 is closest to the nock end 3 of arrow 1. A small ferromagnetic reed switch 28 is positioned in a perpendicular orientation next to the ferromagnetic object 27 which is closest to arrowhead end 2 of arrow 1. Metallic reed switch 28 is constructed by enclosing a pair of metallic reeds within a glass casing and coating the contacts of the reeds with mercury which insures electrical contact in the presence of a perpendicular magnetic field.

With this configuration of latching inertia switch 22, reed switch 28 will remain open when magnet 25 is positioned at the distal end of tube 26 and will close in response to the movement of the magnet 25 to the front end of tube 26.

The movement of the magnet 25 from the distal end to the front end occurs naturally upon the sudden deceleration of arrow 1 when the arrow impacts either with the ground or with the intended target. To move magnet 25 from the front end to the distal end, a hunter needs simply to tap the nock 5 of arrow 1 on a hard surface such as the ground or a rock.

Figure 2:
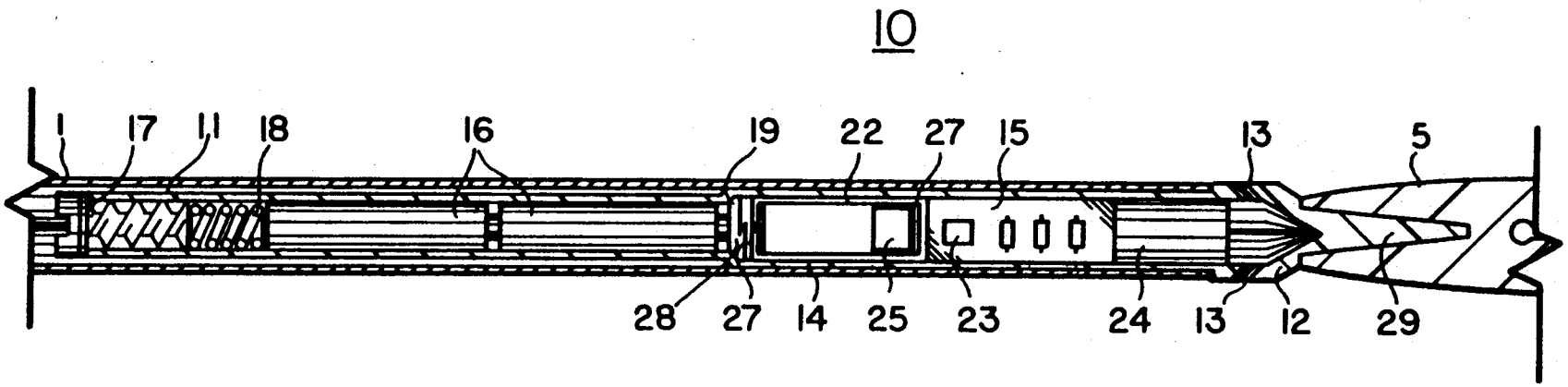
FIG. 2 is a sectional side view of an arrow having the sonic archery beacon installed therein.
Figure 3:
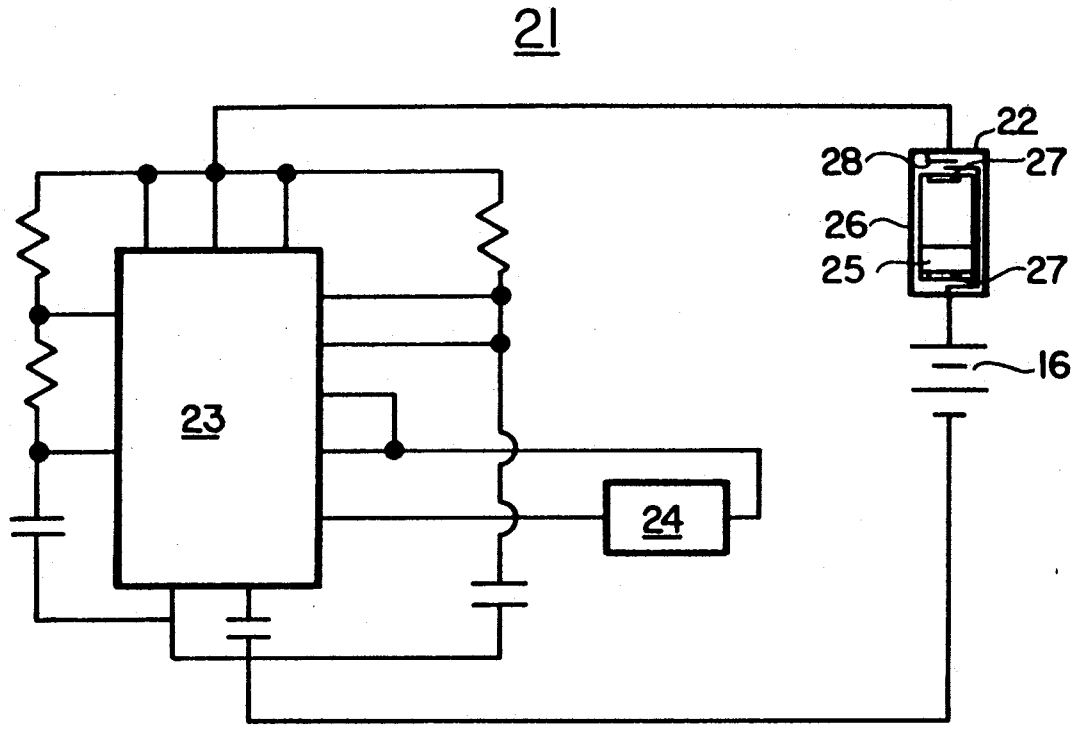
FIG. 3 is an electrical schematic of the circuit for the sonic archery beacon.
Figure 4:
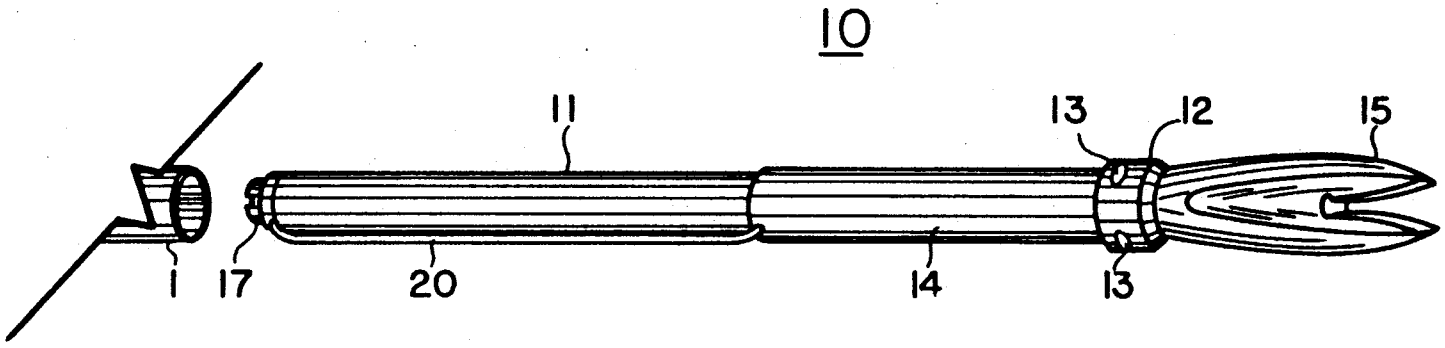
FIG. 4 is an elevation view of the sonic archery beacon.

One contact of metallic reed switch 28 is electrically connected to first battery contact 19. This entire assembly is epoxied within tubular housing 11 in the position shown in FIG. 2. A pair of three-volt cylindrical batteries 16, such as BR425 manufactured by NATIONAL, are then inserted in a serial fashion to provide the necessary six volts to operate the circuit. Battery retaining spring 18 is next inserted into tubular housing 11 followed by battery retaining screw 17. Battery retaining screw 17 provides an electrical contact between one end of wire 20 and batteries 16. Wire 20 extends along tubular housing 11 and has its other end attached to circuit board 15 to complete the electrical circuit.

The completed sonic archery beacon 10 is then epoxied within the nock end 3 of arrow 1 just behind arrow fletching 4. In use, a hunter simply shoots arrow 1 as he would any other arrow. Upon contact, sonic archery beacon 10 will activate and emit a tone which mimics an indigenous sound. The hunter then follows or tracks the sound until he finds arrow 1. To deactivate sonic archery beacon 10, the hunter simply strikes nock 5 against a hard surface such as the ground or a rock.

Figure 5:
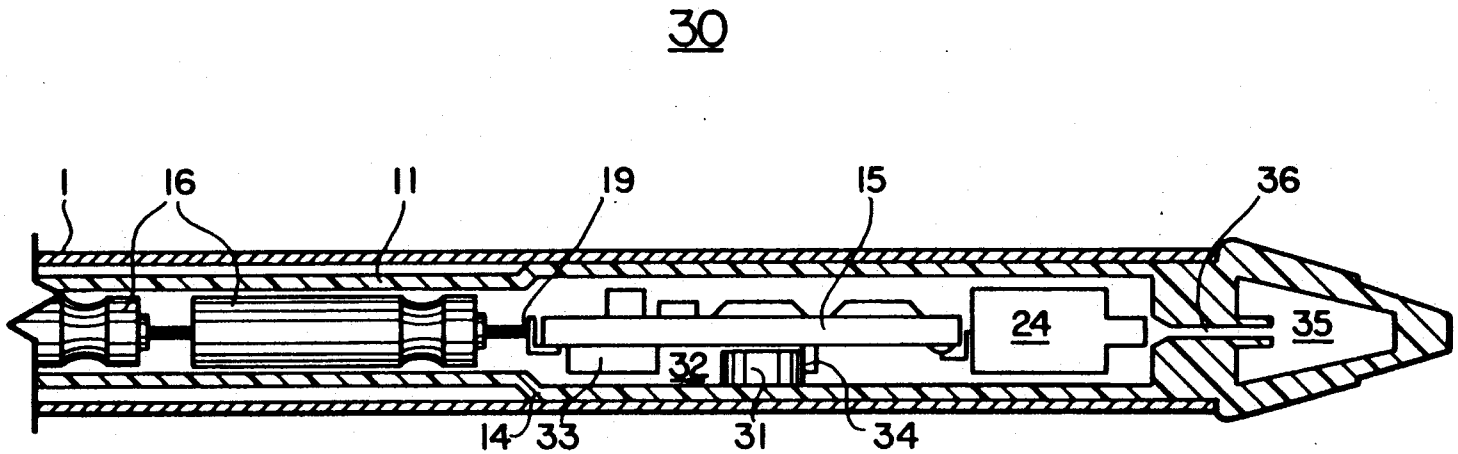
FIG. 5 is a sectional side view of a second embodiment of the sonic arrow finder which implements a different latching magnetic switch.
Figure 6:
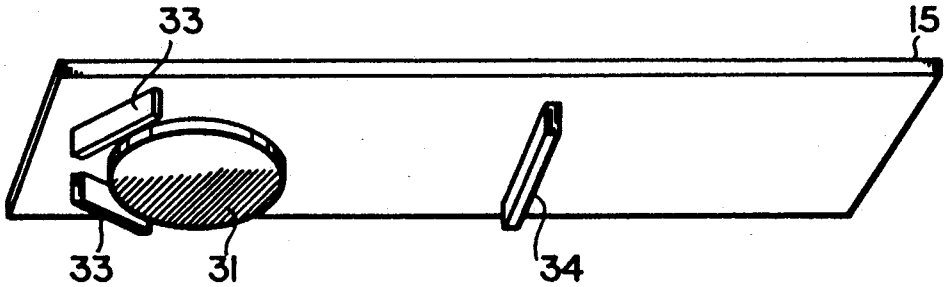
FIG. 6 is a bottom perspective view of one possible circuit board used by the invention which shows the magnetic latching switch of the second embodiment.

A second embodiment of the Sonic Archery Beacon is shown in FIGS. 5 and 6 and is there generally designated as 30. Here, sonic archery beacon 30 employs an electrically conductive magnet 31, in the shape of a puck or disk, to bridge a pair of electrically conductive ferromagnetic contacts 33 and complete the circuit. The inventor has found that a rare earth ceramic such as a neodymium iron-boron magnet works well for the purposes of this invention. The contacts, here ferromagnetic switch contact stops 33, are fixed in spaced relation to the underside of circuit board 15 and arranged such that when magnet 31 is in close enough proximity to the contacts, it will naturally be attracted to the contacts and come into contact with both of them simultaneously to complete an electrical circuit. This configuration eliminates the reed switch of the first embodiment. Contacts 33 are positioned at the arrowhead end of a magnet sliding channel 32 formed by the interior arcuate surface of tubular housing 11 and the underside of circuit board 15. Circuit board 15 is diametrically fixed within tubular housing 11 by potting, epoxy or the like. Both magnet 31 and channel 32 are sized such that the outside dimensions of the magnet are slightly less than the inside dimensions of the channel to permit the magnet to freely slide from the nock end to the arrowhead end of the channel in response to the arrow impacting something.

A ferromagnetic rest stop 34 is also fixed to the underside of circuit board 15 and positioned near the nock end of the arrow 1 within sliding channel 32 to provide a natural resting place for magnet 31 when the circuit is deactivated. By adjusting the strength of the magnet, the size of the ferromagnetic rest stop and/or the distance between the stop and the switch contact stops, one can adjust the amount of force necessary to activate the switch.

Finally, the second embodiment includes a specially configured resonating chamber 35 for sound amplification purposes. As can be seen in FIG. 5, the sound emitted from miniature piezo transducer 24 is directed down an acoustic waveguide or tube 36 into resonating chamber 35 and reflected off a conical shaped surface therein. This configuration has been found to provide a significant amplification of the indigenous sounds.

While there is shown and described the present preferred embodiment of the invention, it is to be distinctly understood that this invention is not limited thereto but may be variously embodied to practice within the scope of the following claims.

We claim:

1. A sonic archery beacon for use in locating a spent arrow within a hunting environment, the arrow having a shaft including an arrow head end and a hollow nock end and a nock, which comprises:

means for generating an audible, pulsed tone signal which mimics pulsed sound of an amphibian, bird, insert or rodent indigenous to the hunting environment, said means being operably secured within the hollow nock end; and inertia activation means being connected to the indigenous audible signal generating means for activating the audible signal generating means.

2. A sonic archery beacon for use in locating a spent arrow within a given habitat, the arrow having a shaft including an arrowhead end and a hollow nock end and a nock, which comprises:

means for generating an audible, pulsed tone signal which mimics a sound indigenous to the habitat, said means being operably secured within the hollow nock end; and inertia activation means being connected to the indigenous audible signal generating means for activating the audible signal generating means wherein the inertia activation means comprises:

an electrically conductive magnet of known outside dimensions;

a generally straight channel being positioned in collinear relation with the arrow shaft and having inside dimensions greater than the outside dimensions of the magnet to facilitate sliding of the magnet therein;

a ferromagnetic stop being fixed near an end of the channel which is closest to the nock end of the arrow;

a pair of ferromagnetic electrically conducting switch contact stops being fixed in spaced relation, one to the other, near an end of the channel closest to the arrowhead end of the arrow; and the switch contact stops being positioned a spaced distance apart but capable of being bridged by the magnet when the magnet is positioned near the arrowhead end of the channel.

3. The sonic archery beacon of claim 2 wherein the channel is defined on one side by an arcuate surface of a tubular housing and on the other side by a surface of a circuit board.

4. The sonic archery beacon of claim 3 wherein the magnet is formed in the shape of a disk or puck from neodymium iron-boron.

5. The sonic arrow locating beacon of claim 4 wherein the indigenous audible signal generating means is configured to produce a sound which mimics a cricket.

6. The sonic arrow locating beacon of claim 3 wherein the indigenous audible signal generating means is configured to produce a sound which mimics a cricket.

7. The sonic arrow locating beacon of claim 2 wherein the indigenous audible signal generating means is configured to produce a sound which mimics a cricket.

8. In combination with an arrow having a shaft including an arrowhead end and a nock end and an electronic arrow locating device located within the shaft of the arrow, an inertia switch comprising:

a tubular housing having a given inside diameter and a pair of opposing ends;

the tubular housing being positioned in collinear relation to the arrow shaft, having a first opposing end closer to the arrowhead end and a second opposing end closer to the nock end;

a circuit board being diametrically positioned within the tubular housing and forming a channel defined by an arcuate interior surface of the tubular housing and a surface of the circuit board;

an electrically conductive magnet having outside dimensions less than the inside dimensions of the channel to facilitate sliding therein;

a ferromagnetic stop being fixed near an end of the channel which is closest to the nock end of the arrow;

a pair of ferromagnetic electrically conducting switch contact stops being fixed in spaced relation, one to the other, near an end of the channel closest to the arrowhead end of the arrow; and the switch contact stops being positioned a spaced distance apart but capable of being bridged by the magnet when the magnet is positioned near the arrowhead end of the channel.

* * * * *